US010364069B2

(12) United States Patent
Lasfargues et al.

(10) Patent No.: US 10,364,069 B2
(45) Date of Patent: Jul. 30, 2019

(54) DEVICE FOR PACKAGING AND DISPENSING A PRODUCT

(75) Inventors: Leandre Lasfargues, Maisons Alfort (FR); Walter Kreidler, Horb (DE)

(73) Assignee: L'OREAL, Paris (FR)

( * ) Notice: Subject to any disclaimer, the term of this patent is extended or adjusted under 35 U.S.C. 154(b) by 1107 days.

(21) Appl. No.: 12/878,790

(22) Filed: Sep. 9, 2010

(65) Prior Publication Data

US 2011/0226792 A1 Sep. 22, 2011

Related U.S. Application Data

(60) Provisional application No. 61/246,559, filed on Sep. 29, 2009.

(30) Foreign Application Priority Data

Sep. 10, 2009 (FR) ..... 09 56208

(51) Int. Cl.
*B65D 43/16* (2006.01)
*B65D 35/12* (2006.01)
*B65D 47/22* (2006.01)

(52) U.S. Cl.
CPC ..... *B65D 35/12* (2013.01)

(58) Field of Classification Search
CPC ..... B65D 35/12
USPC ..... 220/837, 839; 215/235
See application file for complete search history.

(56) References Cited

U.S. PATENT DOCUMENTS

| | | | | |
|---|---|---|---|---|
| 4,728,037 | A * | 3/1988 | Mainhardt | 239/154 |
| 5,586,672 | A * | 12/1996 | Schneider et al. | 215/250 |
| 5,656,346 | A * | 8/1997 | Hirt | 428/36.91 |
| 5,690,764 | A | 11/1997 | Dirksing et al. | |
| 5,913,449 | A * | 6/1999 | Branch et al. | 220/677 |
| 5,985,421 | A * | 11/1999 | Gerber | 428/212 |
| 6,145,707 | A * | 11/2000 | Baudin | 222/189.09 |
| 6,270,867 | B1 * | 8/2001 | Eckstein et al. | 428/35.7 |
| 6,405,896 | B2 | 6/2002 | Jud et al. | |
| 6,511,568 | B1 | 1/2003 | Eckstein et al. | |
| 6,960,375 | B2 * | 11/2005 | Giblin et al. | 428/35.7 |
| 8,486,501 | B2 * | 7/2013 | Manabe et al. | 428/35.7 |
| 2002/0000441 | A1 * | 1/2002 | Redmond | 220/266 |
| 2003/0203080 | A1 * | 10/2003 | Garavaglia et al. | 426/127 |
| 2003/0207060 | A1 * | 11/2003 | Kaschel | 428/35.7 |
| 2006/0249533 | A1 | 11/2006 | Verespej et al. | |
| 2007/0138124 | A1 * | 6/2007 | Skillin | B65D 47/0809 215/235 |
| 2009/0304432 | A1 | 12/2009 | Lasfargues et al. | |

FOREIGN PATENT DOCUMENTS

| | | |
|---|---|---|
| DE | 203 11 719 | 1/2005 |
| EP | 0 668 216 | 8/1995 |
| EP | 1 010 639 | 6/2000 |

(Continued)

*Primary Examiner* — J. Gregory Pickett
*Assistant Examiner* — Niki M Eloshway
(74) *Attorney, Agent, or Firm* — Oblon, McClelland, Maier & Neustadt, L.L.P.

(57) ABSTRACT

The invention relates to a device for packaging and dispensing a product, particularly a cosmetic product, including a body of a receptacle, a dispensing head welded onto the body, one of the body and the head including a layer of a mixture of polypropylene and polyethylene, the other being constituted of polypropylene.

16 Claims, 3 Drawing Sheets

(56) References Cited

FOREIGN PATENT DOCUMENTS

| | | |
|---|---|---|
| EP | 1 138 605 | 10/2001 |
| EP | 1 394 071 | 3/2004 |
| FR | 2 737 704 | 2/1997 |
| FR | 2 872 792 | 1/2006 |
| JP | 2005-001717 | 1/2005 |
| WO | WO 2005/056410 | 6/2005 |

* cited by examiner

DEVICE FOR PACKAGING AND DISPENSING A PRODUCT

CROSS-REFERENCE TO RELATED APPLICATIONS

This application claims priority under 35 U.S.C. § 119(e) that claims the benefit of U.S. Provisional Application No. 61/246,559, filed Sep. 29, 2009, and claims priority under 35 U.S.C. § 119 from French Application No. 09 56208, filed Sep. 10, 2009, the entire contents of each of which are herein incorporated by reference.

FIELD OF THE INVENTION

The present invention relates to a device for packaging a product, particularly a cosmetic product, including a care product or a perfume, a pharmaceutical or even an agri-foodstuffs product.

BACKGROUND OF THE INVENTION

Discussion of Background

One preferred, but not exclusive, area of the present invention relates to the dispensing of a product in fluid form and, in particular, in the form of a lotion, gel, cream, paste or liquid.

"Cosmetic product" is understood to mean a product as defined in Council Directive 93/35/EEC of 14 Jun. 1993.

Documents DE20311719U, EP0668216, EP1010639, EP1138605, FR2737704, FR2872792, JP2005-1717, U.S. Pat. Nos. 5,690,764, 6,405,896 and WO2005056410 disclose prior-art examples of devices for packaging and dispensing a product.

In particular, the prior art discloses devices that comprise a receptacle and dispensing head that are to be fastened to one another, if appropriate by welding, to be produced in one and the same material in order to avoid any incompatibility of material(s).

Document DE20311719U discloses, for example, a device for packaging and dispensing a product that comprises a dispensing head, of the serving capsule type, and a receptacle body, produced in one and the same plastic, such as polyethylene, welded to one another.

Document U.S. Pat. No. 6,405,896 likewise discloses a device for packaging and dispensing a product that comprises a receptacle body and a dispensing head of the serving capsule type, to be produced from one and the same material.

Document U.S. Pat. No. 6,511,568 discloses a method for improving the adhesion between a tube body and a tube head comprising respectively a propylene polymer and an ethylene polymer, wherein a polymer formed by a polymerization reaction with a single site catalyst, for example a metallocene, is blended with the propylene polymer and/or with the ethylene polymer.

The prior art further discloses devices in which an intermediate piece is provided between a receptacle and a dispensing head, serving on the one hand for fastening this receptacle and on the other for fastening said dispensing head.

Document FR2872792 discloses, for example, a device for packaging and dispensing a product that comprises a flexible receptacle body, produced from polyethylene, provided with an attached neck, likewise produced from polyethylene, onto which is snap-fastened a dispensing head of the serving capsule type, produced from polypropylene.

SUMMARY OF THE INVENTION

However, one drawback that is linked to such a device is that it may be considered to be heavy in the technical field under consideration, of high cost price and of complex manufacture.

An object of the present invention is thus to provide a device that overcomes at least one of the above-mentioned drawbacks.

An object of the present invention is to provide a device that requires only a small number of component parts in its production. In particular, an object of the present invention is to provide a device that requires only a very small amount of material for its production. For example, an object is to gain a saving of raw material of the order of 50%.

An object of the invention is likewise to provide a packaging device of very light weight.

An object of the invention is, moreover, to produce a device that requires only a small amount of energy for its production. A further object of the present invention is to provide a device that is easily recycled.

Consequently, an overall object of the present invention is to provide an environmentally friendly device that is easy to manufacture, simple to use and of moderate cost price.

An object of the present invention is likewise to provide a portable device that can easily be carried.

A further object of the present invention is, moreover, to provide a device that allows dispensing of product without substantial effort on the part of the user.

An object of the present invention is likewise to provide a device that is completely leaktight in terms of the product contained inside the device, particularly between the dispensing head and the receptacle, and completely leaktight vis à vis the ambient air. An object of the present invention is, moreover, to provide a device that has an attractive overall appearance, in particular having one or more clean, strong weld lines.

A further object of the invention is, lastly, to provide a device that can withstand passage through a sterilization enclosure, such as an autoclave, with a view to reducing the use of preservatives.

The subject of the present invention is thus a device for packaging and dispensing a product, particularly a cosmetic product, comprising:

a body of a receptacle, a dispensing head welded onto this body, one of the body and the head comprising a layer of a mixture of polypropylene and polyethylene, the other being constituted of polypropylene, the polyethylene of the mixture of polypropylene and polyethylene being preferably present to the extent of 20 to 50%.

This characteristic makes it possible, despite the technical bias against producing, from one and the same material, two pieces to be welded to one another, to improve the welding of the two pieces to one another and to provide a clean weld line. Such a characteristic makes it possible thus to ensure satisfactory fastening of the dispensing head on the receptacle body, thereby making the device not only satisfactorily leaktight at the assembly line but also aesthetically attractive. The device is likewise thereby given a high degree of impact resistance.

The expression "mixture of polypropylene and polyethylene" is meant to cover a mixture composed of polypropylene and polyethylene interacting with one another by means of energy bonds, for example of the Van der Waals type, or covalent bonds, and aims also to cover a mixture composed of ethylene monomers and polypropylene monomers linked together in the form of one or more ethylene and propylene copolymer(s).

The receptacle body may be obtained from the mixture of polyethylene and polypropylene. This receptacle body may be produced from a non-stratified, single-layer sleeve. In a variant embodiment, it may be produced from a sleeve made from several layers, for example obtained by co-extrusion or by bonding using an adhesive such as EVOH provided between two layers. The receptacle body may thus comprise one or more layers, if appropriate each constituted of the mixture of polyethylene and polypropylene, comprising a polypropylene, in one of the forms thereof, mixed with a polyethylene, in one of the forms thereof described below.

The dispensing head itself may comprise one or more layers composed solely of polypropylene in one of the forms thereof, or a mixture thereof. Such forms are described below.

"Polypropylene" should be understood to mean amorphous, crystalline, highly crystalline, isotactic, syndiotactic or atactic polypropylene, or a mixture thereof, or, furthermore, a cast polypropylene. This polypropylene may be a linear, branched or star homopolymer. The polypropylene used is advantageously amorphous or semi-crystalline.

"Polyethylene" should be understood to mean polyethylene of high molar mass, high-density polyethylene, high-density crosslinked polyethylene, medium-density polyethylene, low-density polyethylene, low-density crosslinked polyethylene, low-density linear polyethylene or very-low-density polyethylene. Low-density linear polyethylene is preferred.

The compositions according to the invention may be prepared very easily by mixing the constituents in the molten state.

A common method for producing the mixture of polypropylene and polyethylene consists in producing a mixture of polypropylene granules, for example amorphous polypropylene granules, and polyethylene granules, for example low-density linear polyethylene granules, then in directly converting this mixture into a dispensing head or, preferably, into a receptacle body on an implementation machine of, for example, the extruder or injection press type.

Another method may likewise consist in starting from a mixture of polypropylene powder, for example amorphous polypropylene powder, and polyethylene powder, for example low-density linear polyethylene powder, that is converted into a dispensing head or, preferably, into a receptacle body, directly or after intermediate granulation.

In practice, it is possible to prepare compositions containing 20 to 50% by weight of polyethylene, for example low-density linear polyethylene, with a view to obtaining the desired properties, such as an increase in the flexibility and also in the cold and hot drawability, in addition to increased robustness. These qualities are in particular sought-after for the purposes of conversion using extrusion blow-moulding, extrusion drawing or thermoforming. The implementation of these techniques is thereby facilitated and the articles obtained have better characteristics whilst preserving the appearance of amorphous polypropylene.

Furthermore, a method for producing a copolymerization of ethylene and propylene may, in particular, be implemented using a fluidized-bed manufacturing method.

The polypropylene used in the present invention may have a glass-transition temperature Tg of between 65 and 75° C. and, in particular, of the order of 70° C. It may have a melting point Mp of between 130 and 170°. Its density may be between 0.890 and 0.910 g/cm3 and, in particular, be of the order of 0.905 g/cm3. The polypropylene used in the present invention is, for example, sold under the name MOPLEN RP 210G® by Lyondell Basell.

The polyethylene used in the present invention may have a glass-transition temperature Tg of between 105 and 110° C. and, in particular, of the order of 108° C. It may have a melting point Mp of between 120 and 125°. Its density may be between 0.860 and 0.960 g/cm3 and, in particular, may be of the order of 0.920 g/cm3. The polyethylene used in the present invention is sold under the name DOW LEX 2045G® by Dow Chemical.

The mixture of polypropylene and polyethylene may have a glass-transition temperature Tg of between 100 and 110° C. and, in particular, of the order of 108° C. It may have a melting point Mp of between 160 and 170°. Its density may be between 0.88 and 0.92 g/cm3 and, in particular, may be of the order of 0.90 g/cm3.

The receptacle body may have a wall thickness that is strictly less than 0.6 mm, particularly between 0.3 and 0.4 mm. It may have an extension axis X and may have a section, taken transversely to this axis, of polygonal shape, such as a square, a circle or an oval.

The receptacle body may not be produced from a laminate but from an extrusion die of annular, in particular circular or oval, profile. It may have no dispensing neck. In other words, it may have no shoulder forming a restriction from which a neck rises. This body may thus be a tube of substantially regular cross section, this characteristic being present over substantially its entire height, for example over at least 90%, preferably 95%, even 98% or, furthermore, over 100% of its height.

The dispensing head may include a base that comprises a dispensing opening, and a flap, which is optionally added-on, mounted so as to move between a position in which said opening is closed off and a position in which said opening is clear. In particular, this flap may be mounted so as to pivot on said base between a position in which said opening is closed off and a position in which said opening is clear. This base and this flap may be in the form of a single component, the flap being connected to said base by a film hinge. This flap may, in a variant embodiment, be articulated by a hinge with added pin.

This dispensing head may be obtained by injection-moulding. Such a dispensing head may thus be of the serving capsule type. Such a dispensing head may be made from one or from two materials. This base and this flap may thus, optionally, be made as a single piece produced from identical or different materials.

The base may include a peripheral skirt that includes a rounded portion, as appropriate provided with one or more relief(s), for welding the receptacle body onto the dispensing head.

This base may include reinforcing means arranged on either side of said dispensing opening and designed to facilitate assembly and use of the device. These reinforcing means may include curved-profile ribs.

The receptacle body and the dispensing head may be secured to one another by thermal welding, in particular by means of friction, hot gas, hot jaws, or laser or ultrasound. The device may have a maximum weight of 20 g when empty. Advantageously, this weight may be between 7 and 18 g, for example between 11 and 16 g and, in particular, of the order of 13 g. Such a weight is appropriate, for example, for a receptacle body with a capacity of 200 mL and a diameter of the order of 50 mm. In particular, the body, when empty, may weigh between 7 and 9 g, in particular approximately 8 g. The dispensing head itself may weigh between 4 and 7 g, in particular approximately 5 g.

The device according to the invention may be constituted solely of two pieces, namely a receptacle body closed by a bottom made as one piece with this body, for example by blow-moulding and, in particular, by extrusion blow-moulding, and a dispensing head of the serving capsule type made in the form of a single component and welded onto this body, for example by moulding, particularly injection-moulding. It may likewise be constituted of only three pieces, namely a receptacle body, a bottom attached onto this body, for example by welding, and a dispensing head of the serving capsule type made in the form of a single component and welded onto this body, opposite the attached bottom.

A further subject of the present invention is a device for packaging and dispensing a product, particularly a cosmetic product, comprising:

- a receptacle body comprising a layer obtained from a mixture of polyethylene and polypropylene,
- a dispensing head constituted of polypropylene, said body and said head being welded one in contact with the other.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particular since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

The invention may be better understood on reading the following detailed description, made with reference to the accompanying drawings that illustrate a non-limiting embodiment of the invention, and in which.

DETAILED DESCRIPTION OF THE PREFERRED EMBODIMENTS

Figure 1:
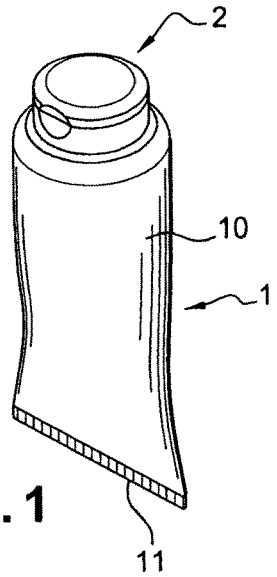
FIG. 1 is a side perspective view in elevation of a first embodiment of a device for packaging and dispensing according to the invention.

Referring now to the drawings, like reference numerals are utilized to designate identical or corresponding parts throughout the several views.

Figure 2:
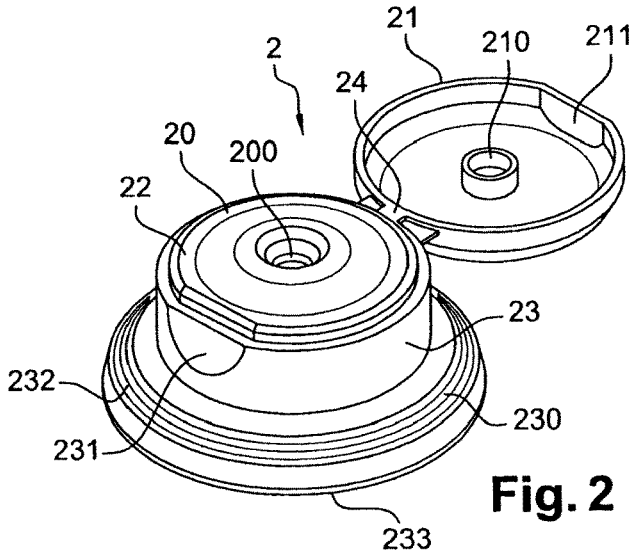
FIG. 2 is a perspective view of the dispensing head represented in FIG. 1, in open configuration.
Figure 3:
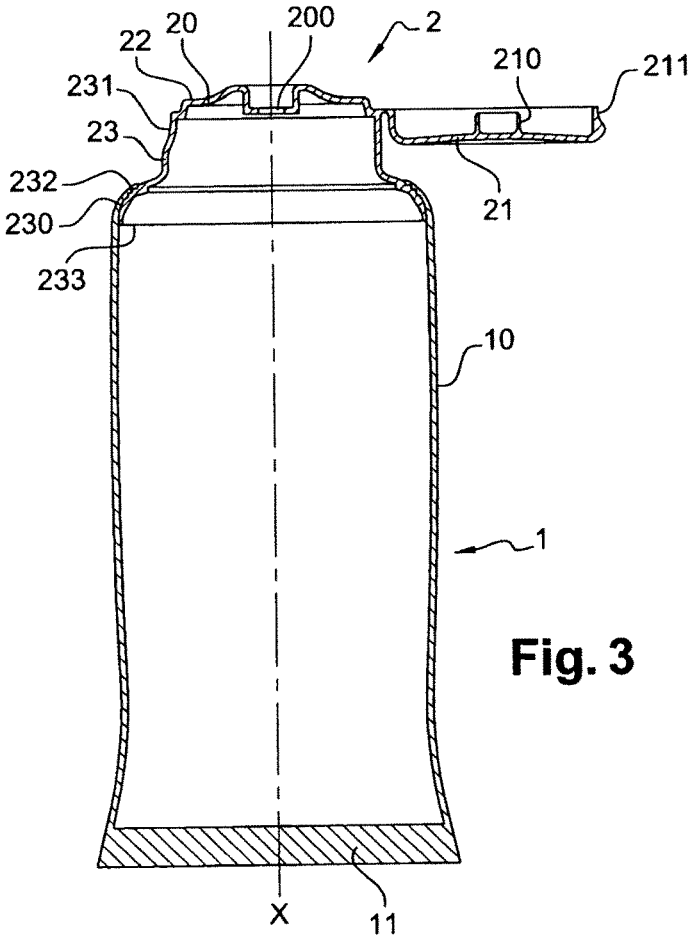
FIG. 3 is a view in longitudinal section of the device represented in FIG. 1 with the dispensing head in open configuration.

FIGS. 1 to 3 represent a first embodiment of a device for packaging and dispensing a product, particularly a cosmetic product, including a care, pharmaceutical or, alternatively, agri-foodstuff product.

This device includes, on the one hand, a receptacle 1 and, on the other, a dispensing head 2.

The receptacle 1 may define an extension axis X. This axis may be an axis of revolution. This receptacle may include a receptacle body or lateral wall 10 comprising two openings opposite one another known as the lower opening and the upper opening, closed off, respectively, on one hand by a bottom 11, which is optionally added on, and provided on the other with the dispensing head 2.

According to the invention, the receptacle body 10 and the dispensing head 2 are welded together, one being constituted of polypropylene and the other produced from a mixture of polypropylene and polyethylene.

The receptacle body 10 may be the result, according to a preferred embodiment, of the cutting of a sleeve or tube extruded through a die of corresponding profile, in particular an annular profile. Such a body may be the result of extrusion blow-moulding.

The receptacle body 10 may have a section, taken transversely to the extension axis X of the receptacle, of polygonal shape, such as a square or a circle or, in the present case, an oval.

In a preferred embodiment, the receptacle body 10 may be obtained from the mixture of polyethylene and polypropylene.

The polypropylene of this mixture may be chosen from an amorphous, crystalline, highly crystalline, isotactic, syndiotactic or atactic polypropylene, or a mixture thereof, or, alternatively, a cast polypropylene. This polypropylene may be a linear, branched or star homopolymer. Amorphous polypropylene is preferred.

The polyethylene may advantageously be a low-density linear polyethylene. The polyethylene may advantageously be present to the extent of 20 to 50%, whilst the polypropylene may be present to the extent of 80 to 50%.

This receptacle body 10 may be formed from a single layer of this mixture. In a variant embodiment, the receptacle body may be constituted of several superposed or coaxial layers, each produced from this mixture. This receptacle body may thus be produced in the form of a laminated or non-laminated, stratified or non-stratified sleeve.

When produced in the form of several layers, the receptacle body 10 may be produced by means of co-extrusion of said layers.

Such a receptacle body 10 may have a thickness that is strictly less than 0.6 mm, preferably less than 0.5 mm. This thickness may advantageously be between 0.3 and 0.4 mm. The bottom 11 of the receptacle 1 may be produced as a single piece with the receptacle body 10. It may, for example, be formed by fastening of the edges of the lower opening of the receptacle using any appropriate means, such as adhesive bonding, welding or the like.

Figure 6:
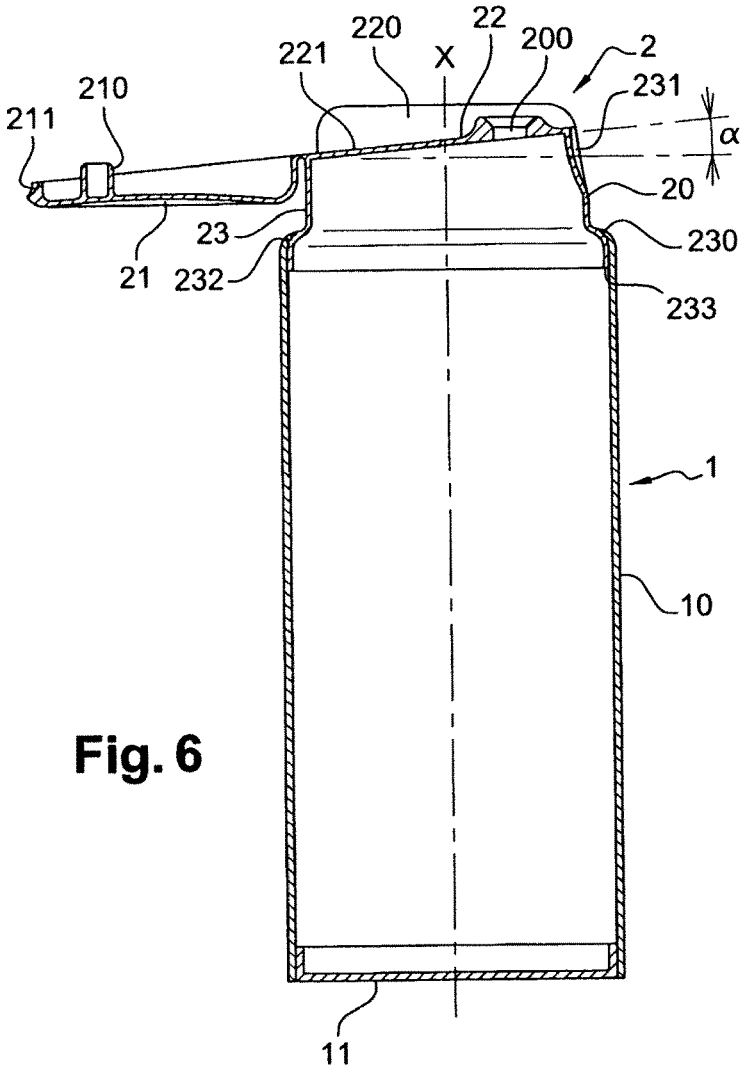
FIG. 6 is a view in longitudinal section of the device represented in FIG. 4, with the dispensing head in open configuration.

According to a variant embodiment, for example illustrated in FIG. 6, the bottom 11 may be attached to the lower opening of the receptacle body and fastened by any appropriate means, such as adhesive bonding, welding or the like.

The dispensing head 2 may be of the serving capsule type. Such a dispensing head may comprise a base 20 that includes a dispensing opening 200 and a cap or flap 21.

This flap 21 may be mounted so as to pivot on said base so that it can move between a position in which said opening 200 is closed off and a position in which said opening 200 is clear. To that end, a hinge may be provided at the rear of the flap.

The flap 21 may comprise a sealing bush 210 configured in order to fit tightly into said opening 200 in the closed-off position.

Such a flap 21 may also comprise a flat or recess 211, located at the front of the flap, opposite the hinge 24, the function of which will be set forth below in the description.

The base 20 may comprise a level part 22 across which said opening 200 is provided. This base may also comprise a peripheral skirt 23.

This skirt 23 may comprise a portion 230 that flares outwards, optionally as far as a free end 233. Such a portion may thus have a curved or rounded profile.

The skirt 23 may comprise one or more reliefs 232, the function of which will be set forth below in this description. These reliefs may be provided on the rounded portion 230. Such reliefs may comprise one or more annular bead(s), which, if appropriate, may be concentric. In a variant embodiment, they may comprise several protuberances, distributed discretely and circumferentially.

The skirt 23 may likewise include a flat or recess 231. In the position in which the opening 200 is closed off by the flap 21, the recess 211 of the flap may be positioned in the extension of the recess 231. Such recesses 211, 231 may then serve for the positioning of one of the user's fingers and, in particular, the user's thumb, with a view to facilitating the raising of the flap 21 from the base 20 when the user wishes to pivot said flap from the position in which it closes off the opening 200 towards the position in which it clears the opening 200.

This dispensing head may be produced as a single piece. In particular, this dispensing head may be made in the form of a single component. More precisely, this head may be produced by moulding, and particularly by injection-moulding. The base 20 and the flap 21 may be articulated in rotation by means of a film hinge 24.

According to a preferred embodiment, the dispensing head 2 is constituted of polypropylene. Once again, the polypropylene used may be an amorphous, crystalline, highly crystalline, isotactic, syndiotactic or atactic polypropylene, or a mixture thereof, or, alternatively, a cast polypropylene. This polypropylene may be a linear, branched or star homopolymer. Non-linear amorphous polypropylene is preferred.

The dispensing head 2 is welded onto the receptacle body 10. In particular, this head and this body may be welded to one another using ultrasound energy. The ultrasonic frequencies used may be between 20 kHz and 100 kHz. The energy consumed may be less than 1200 joules, preferably less than 600 joules, for example between 200 and 500 joules, for example of the order of 250 to 350 joules. Such a weld may be produced over a period of between 0.05 and 2 seconds. In a variant embodiment, a thermal weld or laser weld may be used.

Figure 4:
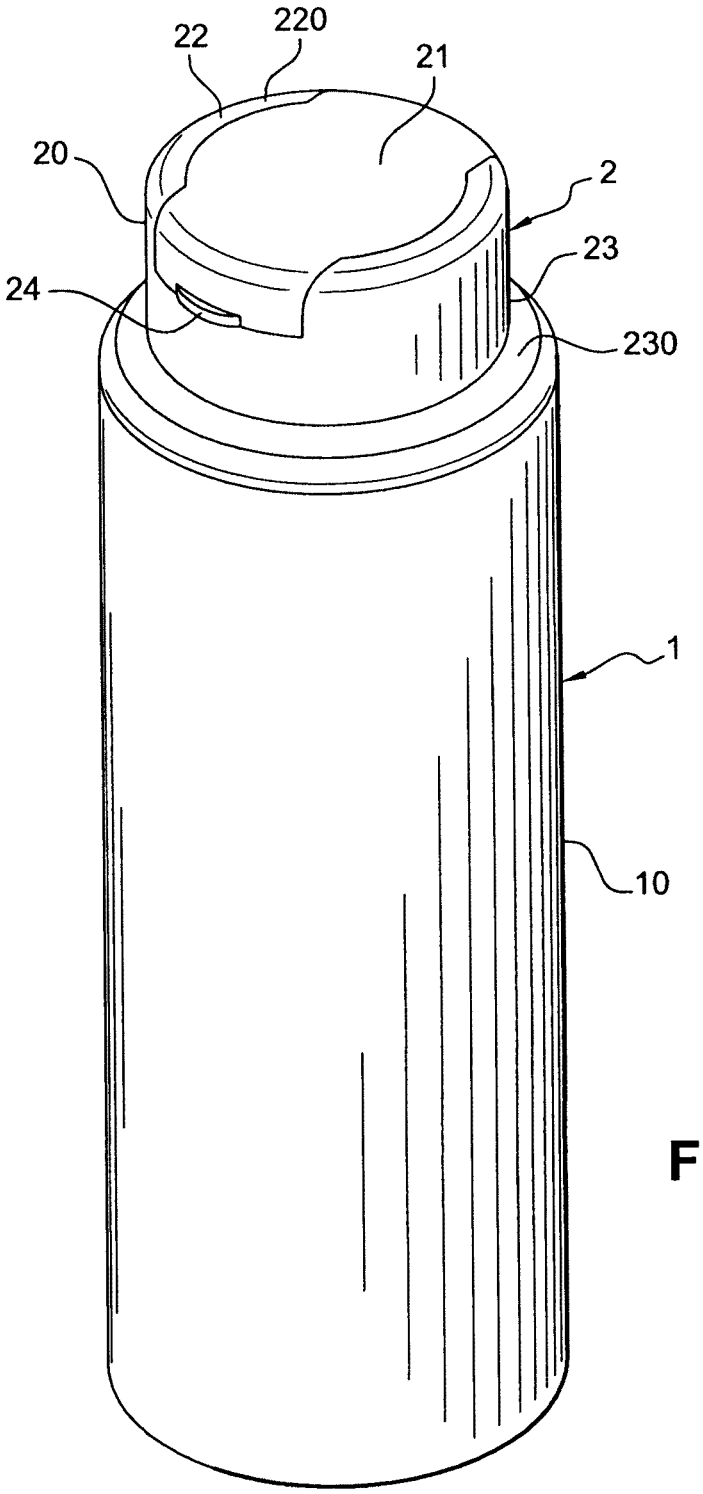
FIG. 4 is a rear, perspective view of a second embodiment of a device for packaging and dispensing according to the invention.
Figure 5:
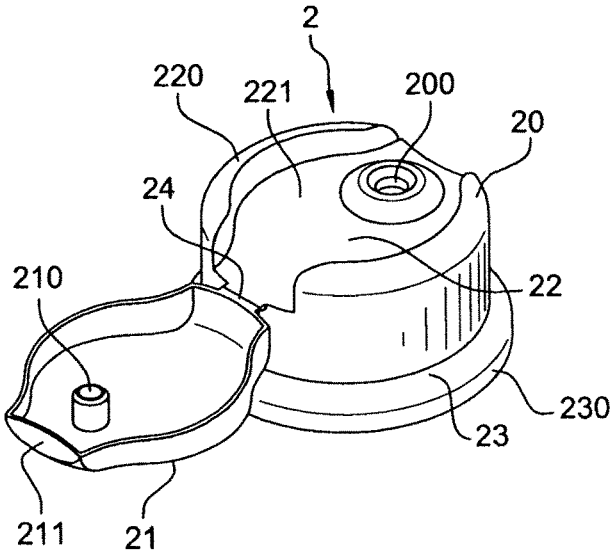
FIG. 5 is a perspective view of the dispensing head represented in FIG. 4, in open configuration.

FIGS. 4 to 6 represent a second embodiment of a device for packaging and dispensing a product according to the invention. For the sake of clarity, only the differences in this second embodiment as compared with the first embodiment will be described. The receptacle body 10 comprises, in this example, a section, taken transversely to the extension axis X, of circular form. This section may be of substantially regular dimensions over the entire height of the receptacle body, for example over at least 90% of its height, preferably 95% or more.

The bottom 11 may optionally be attached to the lower opening of the receptacle body 10 and fastened by any appropriate means, such as by adhesive bonding, welding or the like.

The base 20 may comprise reinforcing means 220 designed to stiffen the dispensing head. These means may comprise a rib extending from the level part 22. In particular, these means may comprise two ribs extending on either side of the dispensing opening 200. Such ribs may have a curved profile. They may extend along the perimeter of the level part 22. These ribs may be useful not only for the purpose of manufacturing the device but also for the use thereof. In particular, they may confer greater stability on the dispensing head during welding of the receptacle body 10 onto the skirt 23, or when the device is placed on a shelf, or greater ease of handling of this device during use. Ribs may, in a variant embodiment or in addition, be provided on the skirt 23. They may extend to the inside or to the outside of this base.

The level part 22 may be at least in part tilted at an angle $\alpha$ relative to a plane transversely intersecting the extension axis X. In particular, the level part may comprise a groove 221 defined by the ribs 220. This groove may be traversed by the dispensing opening 200. This groove may extend in a plane that is inclined relative to the plane transversely intersecting the extension axis X at said angle $\alpha$. This angle $\alpha$ may, for example, be between 1 and 60°, in particular of the order of 15° C. Such a gradient promotes a better supply of product flowing from the receptacle 1 through the opening 200.

In this illustrative embodiment, the opening 200 may be off-centre relative to the extension axis X.

Such a groove 221 may define a housing for the positioning, by correspondence of form, of the flap 21 in the closed-off position.

The product packaged in said device according to the invention may be a cosmetic product, including a care, pharmaceutical or, alternatively, agri-foodstuff product. Such a product may be in fluid form. The cosmetic product may, for example, be a perfume, a sunscreen cream, a self-tanning preparation, a make-up product such as an eyeshadow, a blusher or a foundation, or, alternatively, a care product such as an anti-wrinkle cream or a moisturizer, a hair product such as a shampoo or a gel, or the like.

It should be noted that, according to a further embodiment that can be envisaged, the receptacle body 10 may be constituted of polypropylene, for example the result of extrusion blow-moulding, and the dispensing head 2 may be obtained from the mixture of polyethylene and polypropylene, for example by injection-moulding.

Throughout the description, the expression "that includes a (an)" or "that comprises a (an)" should be considered as synonymous with "that includes at least one" or "that comprises at least one", unless the opposite is specified.

Obviously, numerous modifications and variations of the present invention are possible in light of the above teachings. It is therefore to be understood that within the scope of the appended claims, the invention may be practiced otherwise than as specifically described therein.

The invention claimed is:

1. A device for packaging and dispensing a product, particularly a cosmetic product, comprising:

a body of a receptacle; and a dispensing head welded onto the body, wherein one of the body and the dispensing head including a layer of a mixture of polypropylene and polyethylene, the other of the body and the dispensing head being constituted of polypropylene, wherein the polyethylene of the mixture of polypropylene and polyethylene being present to the extent of 20 to 50%, wherein the entire body of the receptacle is produced as a single layer only of the mixture of polypropylene and polyethylene, wherein the entirety of the dispensing head is constituted of only polypropylene, wherein the dispensing head includes a base, the base having a dispensing opening formed therethrough from a planar top surface of the base to a bottom surface of the base to dispense the product from an interior of the device to an exterior of the device, wherein a plane that extends along the planar top surface of the base also extends through the dispensing opening, wherein the base includes a first and a second reinforcing rib arranged on either side of and spaced apart from said opening, the first and the second reinforcing ribs are spaced apart from each other and discontinuous along a perimeter of the planar top surface of the base, wherein the plane that extends along the planar top surface is tilted at an angle of about 15 degrees with respect to a plane transversely intersecting a longitudinal axis of the body, wherein at least a portion of the first and second reinforcing ribs extend upwards in a longitudinal direction of the receptacle body from the top surface of the base on a first side of the plane, and wherein the receptacle body is located on a second side of the plane which is opposite to the first side of the plane.

2. The device according to claim 1, wherein the polyethylene of the mixture of polypropylene and polyethylene is a low density linear polyethylene.

3. The device according to claim 1, wherein the body of the receptacle has a wall thickness that is less than 0.6 mm.

4. The device according to claim 3, wherein the body of the receptacle has a wall thickness that is between 0.3 and 0.4 mm.

5. The device according to claim 1, wherein the body of the receptacle has a cross section, taken transversely to the longitudinal axis, of polygonal, circular or oval shape.

6. The device according to claim 1, wherein the body of the receptacle is produced from a tubular sleeve obtained by extrusion through a die of corresponding shape.

7. The device according to claim 1, wherein the dispensing head includes a flap mounted so as to move between a position in which said opening is closed off and a position in which said opening is not closed off.

8. The device according to claim 7, wherein the base and the flap are in the form of a single component, said flap being connected to said base by a film hinge.

9. The device according to claim 7, wherein the first and second reinforcing ribs have a curved profile.

10. The device according to claim 1, wherein the base includes a peripheral skirt that includes a rounded portion.

11. The device according to claim 1, wherein the dispensing head is obtained by injection moulding.

12. The device according to claim 1, wherein the body of the receptacle and said dispensing head are welded to one another by ultrasonic welding.

13. The device according to claim 1, wherein the device has a maximum weight when empty of 20 g.

14. The device according to claim 1, wherein the dispensing head includes a sealing bush, a flat or a recess.

15. The device according to claim 1, wherein the dispensing head further comprises a skirt comprising one or more reliefs.

16. The device according to claim 1, wherein the receptacle body does not have a dispensing neck.

* * * * *